US007431633B2

(12) United States Patent
Tanaka

(10) Patent No.: US 7,431,633 B2
(45) Date of Patent: Oct. 7, 2008

(54) PLATING REMOVING APPARATUS FOR THREE-PIECE WHEEL

(75) Inventor: Takeshi Tanaka, Osaka (JP)

(73) Assignee: Work Co., Ltd., Higashiosaka-Shi (JP)

( * ) Notice: Subject to any disclaimer, the term of this patent is extended or adjusted under 35 U.S.C. 154(b) by 0 days.

(21) Appl. No.: 11/499,857

(22) Filed: Aug. 7, 2006

(65) Prior Publication Data

US 2007/0042678 A1 Feb. 22, 2007

(30) Foreign Application Priority Data

Aug. 22, 2005 (JP) ..... 2005-239364
Jun. 5, 2006 (JP) ..... 2006-155692

(51) Int. Cl.
*B24B 49/00* (2006.01)
*B24B 51/00* (2006.01)

(52) U.S. Cl. ..... 451/8; 451/10; 451/254; 451/258

(58) Field of Classification Search ..... 451/5, 451/8, 10, 49, 178, 242, 246, 254, 258, 367, 451/379, 398
See application file for complete search history.

(56) References Cited

U.S. PATENT DOCUMENTS 5,537,850 A * 7/1996 Inatani ..... 72/85
5,989,108 A * 11/1999 Ikeda et al. ..... 451/268
6,672,122 B2 * 1/2004 Mustread et al. ..... 72/101
7,063,607 B2 * 6/2006 Sim ..... 451/490
7,228,629 B2 * 6/2007 Beyer ..... 29/894.35
7,270,382 B2 * 9/2007 Hodges et al. ..... 301/63.101

FOREIGN PATENT DOCUMENTS

JP 11-236681 8/1999

* cited by examiner

*Primary Examiner*—Timothy V Eley
(74) *Attorney, Agent, or Firm*—Kratz, Quintos & Hanson, LLP

(57) ABSTRACT

To provide a plating removing apparatus for 3-piece wheels, which can easily and neatly remove plating at the welding planned portion of the superimposed part of the inner rim and the outer rim. A plating removing apparatus that removes plating of a welding planned portion R in a three-piece wheel having the inner rim 2B, the outer rim 2A, and a disk, comprises a support means 11 that rotatably supports the outer rim 2A, at least three holding rollers 34 that hold the rim supported by the support means 11 from the outer circumferential side, a rotation drive means 67 that rotates and drives the outer rim 2A held by the holding rollers 34, and a grinding means that grinds the welding planned portion R on the outer circumferential surface of the rim 2A by an abrasive cloth/paper 13 and removes plating the welding planned portion R.

9 Claims, 8 Drawing Sheets

(a)

(b)

(a)

(b)

PLATING REMOVING APPARATUS FOR THREE-PIECE WHEEL

BACKGROUND OF THE INVENTION

1. Technical Field

The present invention relates to a plating removing apparatus for a three-piece wheel which removes plating of a welding planned portion on a curved outer circumferential surface linked from a superimposed portion of rims to a body part in a three-piece wheel which has an inner rim, an outer rim, and a disk.

2. Background Art

Widely practiced vehicle wheels made of aluminum alloys and other light alloys include a one-piece wheel integrally formed by molding, a two-piece wheel configured by dividing the wheel into two parts that are a rim and a disk, and a three-piece wheel configured by dividing the wheel into three parts that are an inner rim, an outer rim, and a disk. Wheels subjected to a treatment of chromium plating or other plating to enhance their design features are also extensively put into practical use (refer to Japanese Unexamined Patent Publication No. Hei 11-236681).

In general, when a three-piece wheel is fabricated, there is a manufacturing method widely used to form an annular superimposed part that extends to an inner side in the radial direction in both an inner rim and an outer rim, and both of the superimposed portions are stacked together while stacking an outer circumferential part of a disk on this superimposed portion stacked, in which these three parts are tighten with bolts, and the superimposed portion is welded between the inner rim and the outer rim from an outer circumferential side so as to integrate both of the rims airtightly into one.

In addition, in the three-piece wheel, in order to enhance design features, the disk and the outer rim are subjected to a plating treatment while the inner rim having virtually no effect on the design features is subjected to an alumite treatment in place of a plating treatment in order to reduce a manufacturing cost. Furthermore, in order to prevent welding defects among the rims caused by plating or oxide layer, the outer rim is immersed in plating liquid to carry out a plating treatment in a state that a welding planned portion is subjected to masking, or after the plating treatment, plating of the welding planned portion is removed by a manual operation using a portable grinder or the like, or plating of the welding planned portion is removed by cutting in a machine process, while an oxide film of the welding planned portion is removed in the inner rim by a manual operation using, for example, a wire brush or the like.

SUMMARY OF THE INVENTION

In the event that masking is provided to a welding planned portion of the outer rim and a plating treatment is carried out, troublesome processes such as affixing a masking tape is required. Since the plating treatment generally requires a special technique which is not carried out by a wheel manufacturer but by a manufacturer specialized in plating treatment, there arises a problem of increased labor cost in the plating treatment counted for affixing a masking tape as well as an increased wheel manufacturing cost.

Since delicate irregularities are formed on an outside surface of the outer rim, even if the masking tape is neatly affixed, when the rim is immersed in plating liquid, the plating liquid invades between the masking tape and the rim, thereby part of a welding planned portion may be plated, and the plating part in the welding planned portion constitutes one of the causes of welding defects. Furthermore, in the event that chromium plating is provided as a plating treatment, the rim is successively immersed in a plurality of treatment liquids, the plating liquid invaded between masking tape and the rim is brought into other treating liquid in the subsequent processes, creating a problem of contaminating treatment solutions of the subsequent processes. Still more, an adhesive component of the masking tape is dissolved into treatment liquid, resulting in a problem of degrading the treatment solution.

Furthermore, in the case of masking, as shown in FIG. 10, in a boundary part 103 formed between a base material area 101 and other plating area 102 by affixing a masking tape at a welding planned portion of a rim 100, an elevated part 104 is formed along a side edge of the masking tape in the plated area 102, and a level difference is formed at the boundary part 103 between the base material area 101 and the plated area 102, thereby plating is easily exfoliated by a physical shock, or an incomplete plated area 105 including, for example, a copper plating layer in the case of chromium plating is formed as a substrate layer by the plating liquid invaded between the masking tape and the rim, causing the plated area 102 to be easily exfoliated from the incomplete plated area 105.

On the other hand, in the event that plating of a welding planned portion is removed by cutting or the like in a machine process, plating of the welding planned portion can be neatly removed and the masking tape affixing process is not required, and since no masking tape affixing is required, thereby a labor cost used for the plating treatment can be made inexpensive, and a wheel manufacturing cost can be reduced. However, cutting the plated area by a single cutting treatment causes a force exerted on the plated area in the direction to exfoliate the plating when the cutting tool is withdrawn from the plated area, resulting in a problem of easy exfoliation of the plated area from the boundary adjacent to the base material portion. In addition, in order to prevent this, it is considered to insert the cutting tool from both side edges of the welding planned portion and to withdraw the cutting tool at halfway in the width direction of the welding planned portion. However, it is required to perform the cutting treatment twice, resulting in an extremely troublesome process which is problematic. Furthermore, in the event of removing plating of an outer circumferential face of a curved part linked from a superimposed portion among rims to a cylindrical body part as is the case of a three-piece wheel, a cutting tool must be moved along the curved surface of the curved part and different types of wheels have different curvatures of the curved parts, causing a problem that control of the cutting tool is made to be extremely complicated.

In addition, in a method to remove plating of a welding planned portion by a manual operation using a portable grinder or the like, a processing is carried out from an outer circumference side of an outer rim, enabling a comparatively easy removal of plating even at a curved welding planned portion, but there are problems of a necessity of workforce and more variations may be observed in dimensional accuracies and surface properties of the ground surfaces.

It is an object of the present invention to provide a plating removing apparatus for three-piece wheels, which can easily and neatly remove plating of a welding planned portion in a superimposed part of an inner rim and an outer rim.

A plating removing apparatus for three-piece wheels related to the present invention is a plating removing apparatus which removes plating of a welding planned portion on an outer circumferential surface of a curved portion linked from a superimposed part among rims to a cylindrical body part in a three-piece wheel which has an inner rim, outer rim, and disk, and has a support means that rotatably supports the rims, at least three holding rollers that hold the rims supported by the support means, a rotation drive means that rotates and drives the rims held by the holding rollers, and a grinding means that grinds the welding planned portion on the outer circumference of the curved part of the rim with an abrasive cloth/paper and removes the plating of the welding planned portion.

In the event of removing plating of a welding planned portion of a rim by the use of this plating removing apparatus, the rim is loaded on the support means with the superimposed part side above so that, for example, a center axis of the rim is directed in the vertical direction, in which the holding rollers are rotated by the rotation drive means in a state that an outer circumferential part of the rim is supported by at least three of the holding rollers, the welding planned portion is ground by the grinding means while the wheel is being rotated at a low speed of, for example, 5 to 50 rpm, and plating of the welding planned portion is removed. In this plating removing apparatus, plating is ground and removed by the grinding means, thereby plating such as hard chromium plating and others can be neatly removed. In addition, when a plating treatment is provided for both inner and outer rims, both of the rims are successively set to the plating removing apparatus and plating of a welding planned portion is removed. Since the inner rim has generally little effect on design features of the wheel, expensive plating is not provided but alumite treatment that can be carried out at low price is provided for the inner rim. When the alumite treatment is carried out on the inner rim, plating of a planned welding portion is removed by this plating removing apparatus for an outer rim only, and for an inner rim, an oxide film of the welded planned portion is removed by a wire brush or the like.

Now, using a flap wheel with an abrasive cloth radially arranged as the abrasive cloth/paper, the flap wheel is pressed substantially vertically to be in contact with a center part of a welding planned portion so as to grind the welding planned portion in the grinding means. If the flap wheel stated above is used, an outer circumferential part of the flap wheel is brought in pressure-contact with the welding planned portion while it bends along the welding planned portion, thereby the welding planned portion and the plated area can be ground into a smooth surface without forming a level difference.

It is also possible to install a measuring means that measures a protrusion rate of the holding roller when the rim is held by the holding roller so that a diameter of the wheel is calculated on the basis of the output from the measuring means, and a moving means that moves the grinding means in such a manner that the abrasive cloth/paper is brought in contact with a welding planned portion in accordance with the calculated result. In such event, it is made possible to automatically adjust a positional relationship between the grinding means and a rim in accordance with an outside diameter size of the rim.

According to the plating removing apparatus of the three-piece wheel related to the present invention, plating of a welding planned portion is removed by grinding, thereby plating of the welding planned portion can be neatly and efficiently removed. In addition, because plating of the welding planned portion can be neatly removed, welding defects of both inner and outer rims can be prevented and strength loss due to welding defects or air leakage of tires from the welding defective portion can be effectively prevented.

Furthermore, because the welding planned portion at the superimposed part is of a cross-sectional profile protruding to the outside, it is possible to form a smooth surface between the welding planned portion from which plating was removed and a plated area without forming a level difference, and as compared to the case of masking or cutting, exfoliation of plating at a boundary can be effectively prevented. Furthermore, since plating is removed by grinding, as compared to the case of removing plating by cutting, the grinding force in the direction to exfoliate plating can be remarkably reduced, and exfoliation of plating from the boundary part can be effectively prevented.

Furthermore, as compared to the case of masking, a process of affixing a masking tape is not required, thereby a labor cost used for a plating treatment can be reduced and a wheel manufacturing cost can be reduced.

In the event of using the flap wheel in which the abrasive cloth is radially arranged as the abrasive cloth/paper, and grinding a welding planned portion by substantially vertically pressing the flap wheel to be in contact with a center part of the welding planned portion by the grinding means, the welding planned portion can be ground while an outer circumferential part of the flap wheel is being bent along a curvature of the welding planned portion; a required width of the welding planned portion can be neatly ground by a single grinding treatment, excessive grinding of the welding planned portion can be prevented, formation of smooth surfaces is made possible between the welding planned portion and the plated part without forming a level difference, and exfoliation of plating at the boundary can be effectively prevented further more. In addition, even if a wheel has a different curvature at the welding planned portion a grinding treatment can be carried out by the same flap wheel, thereby operability of the grinding treatment can be improved.

In addition, if the measuring means and moving means are provided, a positional relationship between the grinding means and a rim can be automatically set in accordance with an outside diameter size of the rim and the plating removing operation can be effectively carried out further more.

DETAILED DESCRIPTION OF THE INVENTION

Figure 1:
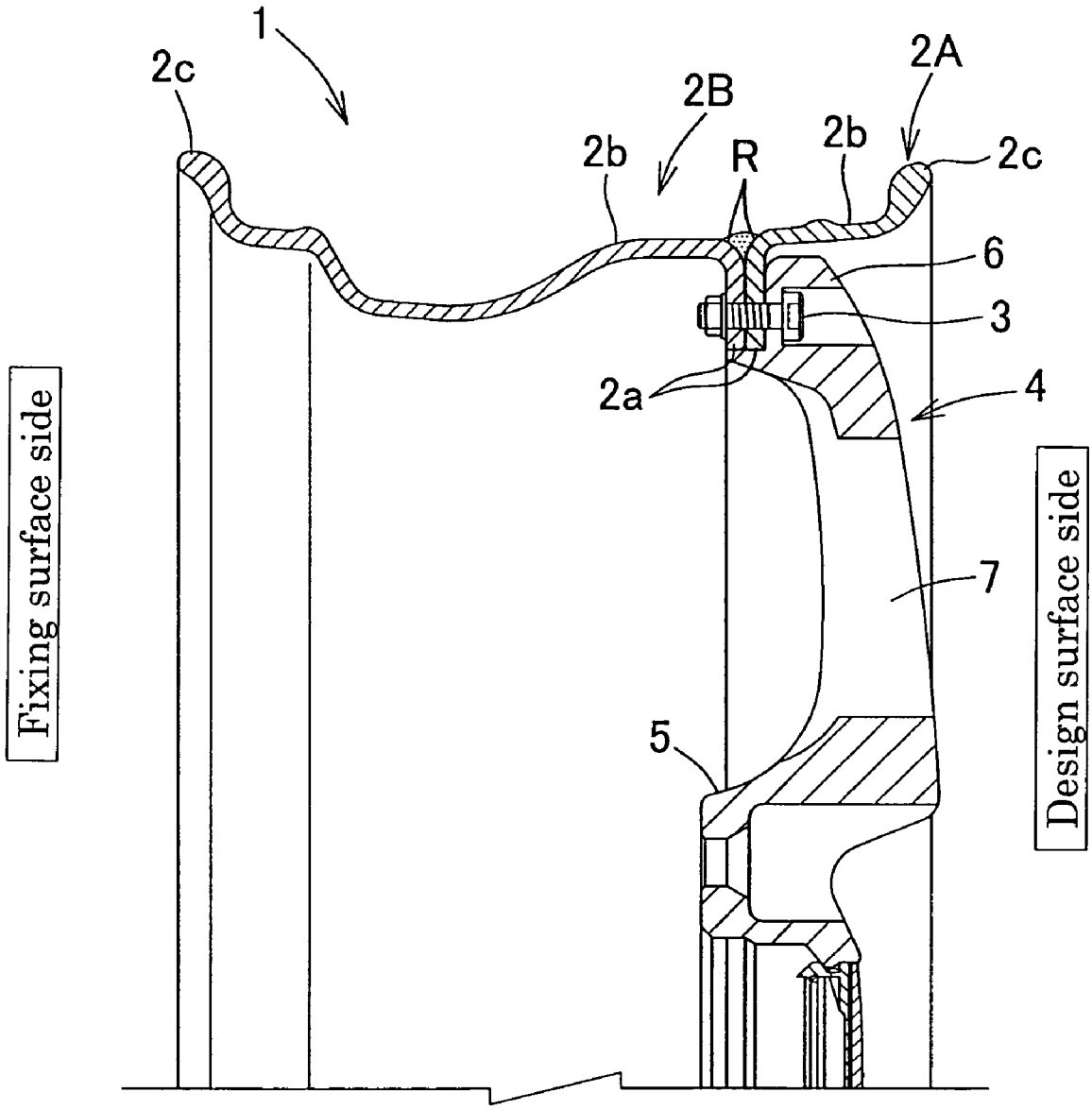
FIG. 1 is a cross-sectional view of a three-piece wheel.

Referring to the drawings, embodiments of the present invention will be described in detail hereinafter.

First of all, description will be made on a three-piece wheel 1.

As shown in FIG. 1, the three-piece wheel 1 has a substantially cylindrical outer rim 2A and an inner rim 2B which have an annular superimposed part 2*a* extending to the inner side on one end part, and a disk 4 that is fixed to the superimposed part 2*a* of both the outer rim 2A and the inner rim 2B with a bolt 3.

The disk 4 is integrally formed using aluminum alloys and other lightweight metal material by casting, press-forming, and forging or the like, and a whole surface of the disk 4 is subjected to a plating treatment by, for example, chromium-plating. The plating treatment is carried out by a widely known method to immerse the disk 4 in plating liquid. However, the disk 4 is not always provided with the plating treatment and may be provided with coating.

The disk 4 is equipped with a fixing part 5 to a wheel support member (omitted from drawings), an annular ring part 6 installed in such a manner as to surround and enclose the fixing part 5 and a spoke part 7 that joins the fixing part 5 to the ring part 6.

Both of the outer rim 2A and the inner rim 2B are composed of metal material with superb stretchability such as aluminum alloys. A whole surface of the outer rim 2A is subjected to a plating treatment such as chromium plating by a widely known method to immerse the outer rim 2A in plating liquid in order to improve design features thereof. Although the inner rim 2B may be provided with chromium plating in the same manner with the outer rim 2A it is a member that scarcely affects the design features, an alumite treatment which can be implemented at low cost is provided.

To the outer rim 2A and the inner rim 2B, a substantially cylindrical body part 2*b* linked to the superimposed part 2*a* is formed, and at the end part on the design surface side of the outer rim 2A and the end part on the fixing surface side of the inner rim 2B, flange parts 2*c* are formed by increasing a wall thickness to have a wall thicker than other parts, respectively. Because the flange part 2*c* is configured to have a thick wall by increasing the wall thickness as stated above, when the outer rim 2A is subjected to a plating treatment, plating liquid is securely prevented from remaining in the flange part 2*c* so that corrosion of the flange part 2*c* by the remaining plating liquid can be prevented. In addition, because the flange part 2*c* of both the outer rim 2A and the inner rim 2B is configured to have a thick wall, strength and rigidity of a wheel 1 can be sufficiently secured during rotation or the like.

On an outer circumferential surface of a curved part linked from the superimposed part 2*a* to the body part 2*b*, a welding planned portions R are formed respectively by removing plating and oxide film to expose the base material. Plating of the welding planned portion R of the outer rim 2A is removed by a plating removing apparatus 10 discussed below to expose the base material, while oxide film of the welding planned portion R of the inner rim 2B is removed by a wire brush or the like to expose the base material. However, when a plating treatment is provided for the inner rim 2B, plating of the welding planned portion R of the inner rim 2B is removed by the plating removing apparatus 10 discussed below in the same manner with the outer rim 2A.

When the wheel 1 is assembled, the superimposed parts 2*a* of both the outer rim 2A and the inner rim 2B are superimposed while fixing an outer circumferential part of the disk 4 to this superimposed part 2*a* with the bolt 3 to integrate the outer rim 2A, the inner rim 2B and the disk 4 into one, after which both of the welding planned portions R are welded and assembled from the outer circumferential side.

Referring to drawings, next discussion is made on a plating removing apparatus 10 for removing plating at welding planned portions of the outer rim 2A and the inner rim 2B.

Figure 2:
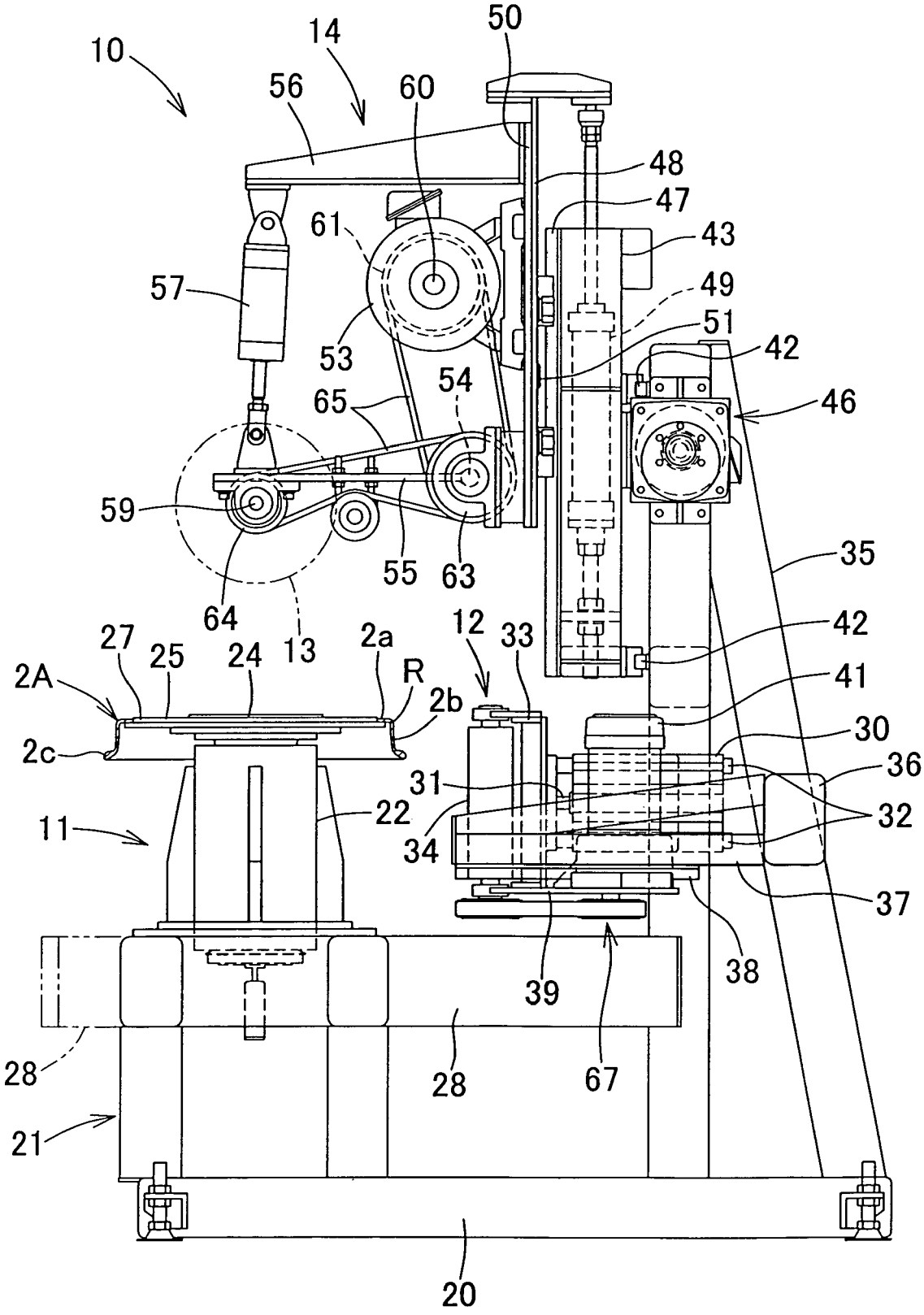
FIG. 2 is a front view of a plating removing apparatus.
Figure 3:
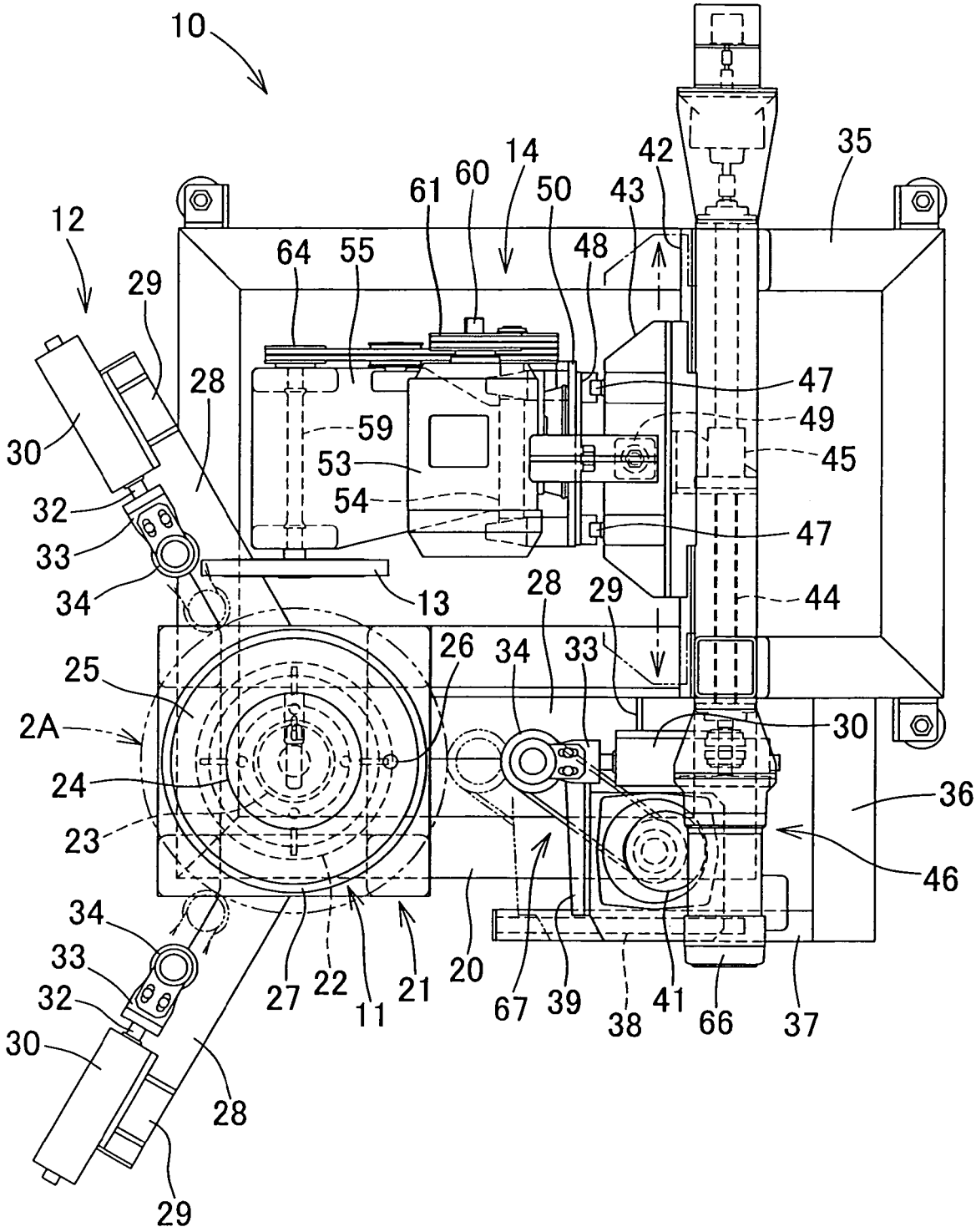
FIG. 3 is a plan view of the plating removing apparatus.
Figure 4:
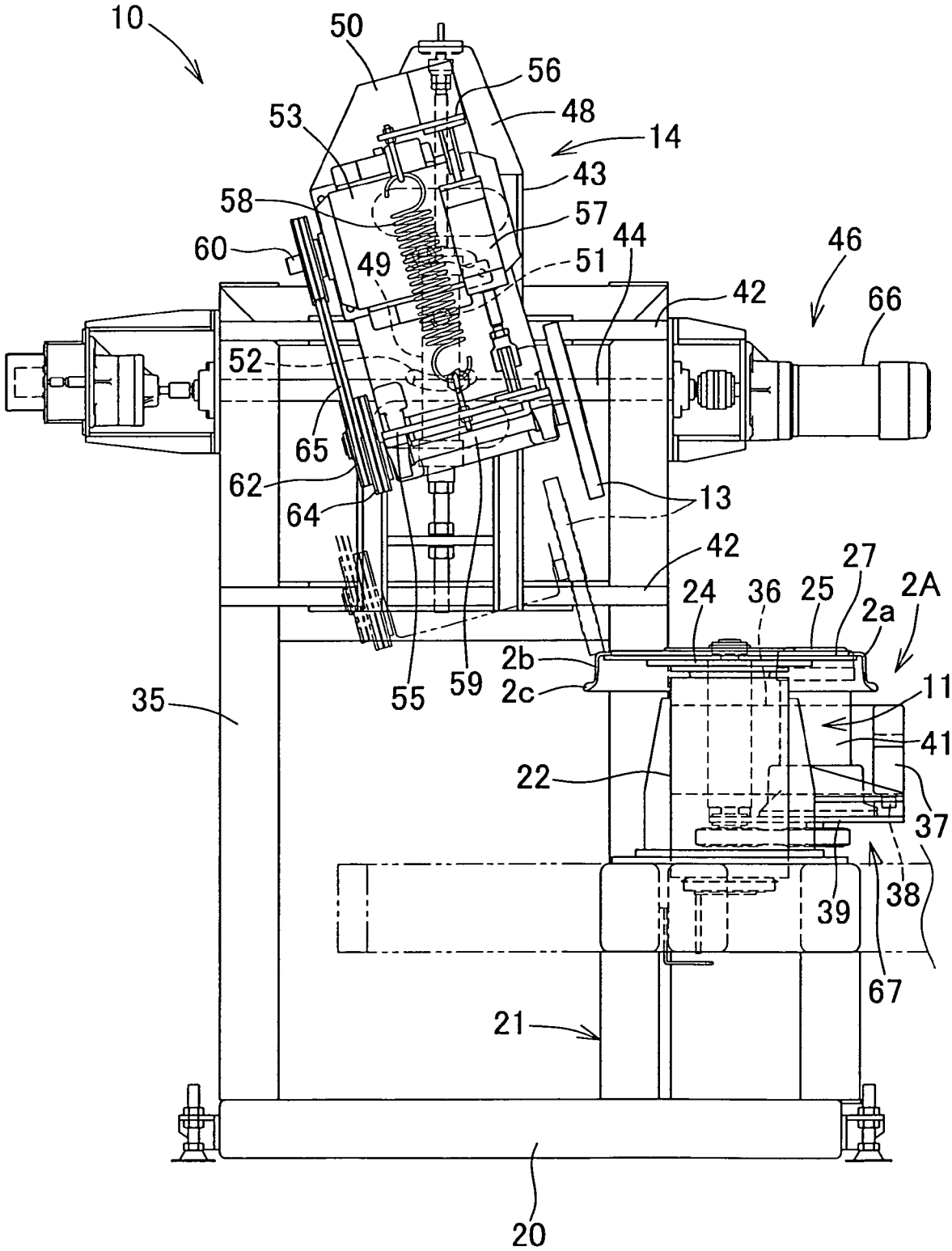
FIG. 4 is a left side view of the plating removing apparatus.
Figure 5:
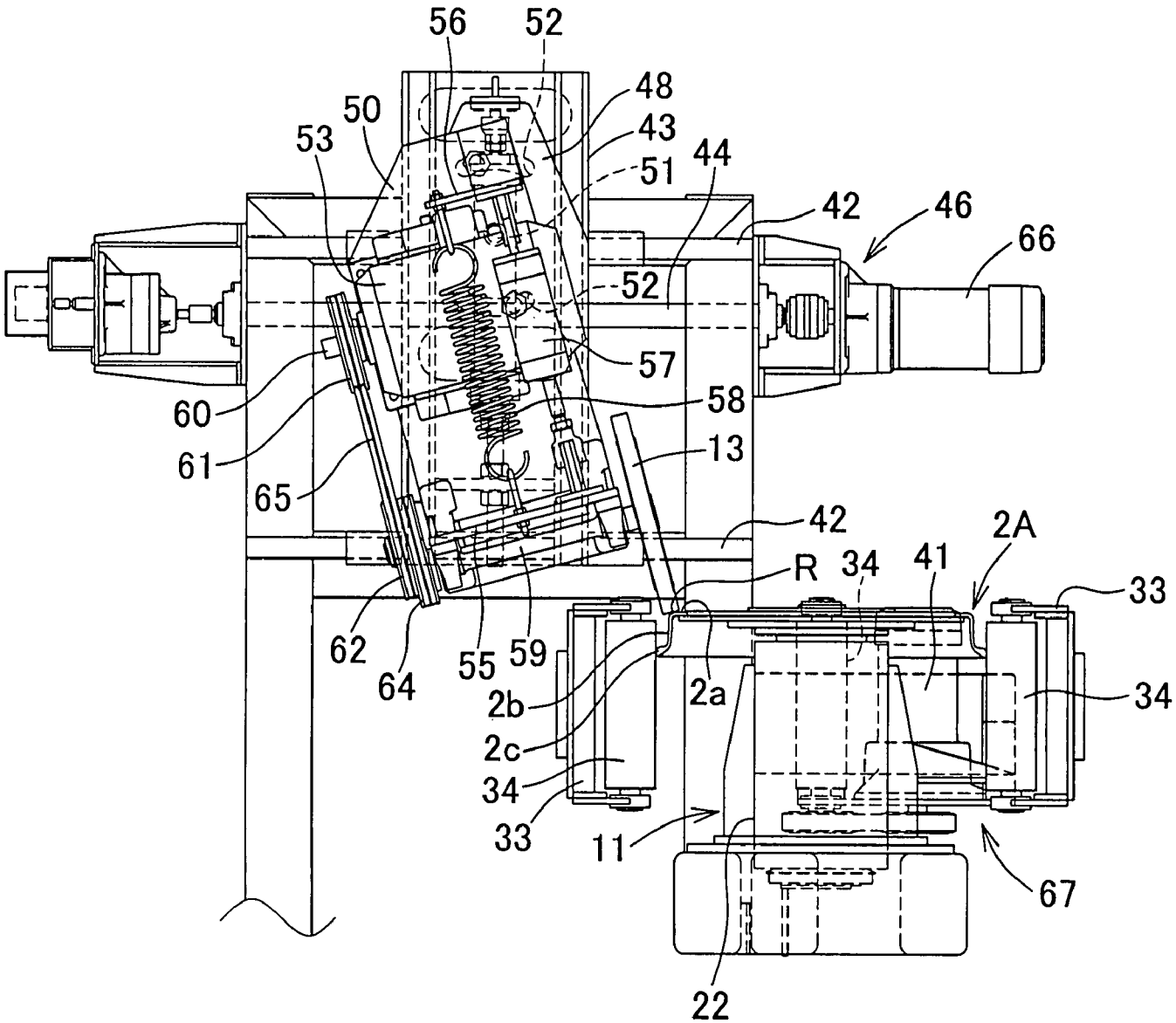
FIG. 5 is a view explaining an operation in a grinding treatment.

As shown in FIG. 2 through FIG. 4, the plating removing apparatus 10 is equipped with a support means 11 that rotatably supports the outer rim 2A in which a center axis thereof is held substantially vertical, a rotation drive means 12 that rotates and drives the outer rim 2A supported by the support means 11 from an outer circumferential side, and a grinding means 14 that removes plating of the welding planned portion R by grinding the welding planned portion R on an outer circumferential surface of a curved part of the outer rim 2A with an abrasive cloth/paper 13.

The support means 11 will be explained. As shown in FIG. 2 through FIG. 4 and FIG. 8, a support table 21 is fixedly installed on a lower frame 20, a support tube 22 is uprightly fixed on the support table 21, and a shaft member 23 is rotatably supported in the inside of the support tube 22. A rotary plate 24 is fixed to the top end part of the shaft member 23, and an annular jig plate 25 is rotatably mounted to the outer circumferential part of the rotary plate 24 by a pin member 26 in such a manner as to prevent a relative rotation. The outside diameter of the jib plate 25 is set to a size slightly larger than the inside diameter of the superimposed part 2*a* of the outer rim 2A, an annular level difference part 27 is formed to an outer circumferential part of the jig plate 25. The outer rim 2A is removably supported by the jig plate 25 by fitting the superimposed part 2*a* over the level difference part 27. It is possible to provide a configuration that the outer rim 2A of various sizes is supported to the support means 11 by replacing the jig plate 25 with different sized outside diameter.

The rotation drive means 12 will be explained. As shown in FIG. 2, FIG. 3, FIG. 6, and FIG. 7, the support plate 21 is provided with a support arm 28 which extends outwards at intervals of about 120° in the circumferential direction with the shaft member 23 set as the center. A support bracket 29 which extends upwards is installed on an upper side of an external end part of the support arm 28. On an upper end side part of the support bracket 29, an air cylinder 30 is installed with the output rod 31 and the guide rod 32 directed toward the support means 11. A mounting member 33 is installed on head end parts of the output rod 31 and the guide rod 32 of the air cylinder 30, and a holding roller 34 is rotatably supported by the mounting member 33 with a center axis thereof directed in the vertical direction. The outer rim 2A supported by the support means 11 is rotatably held by pressurizing three of the holding rollers 34 in contact with an outer circumferential part of the flange part 2*c*.

As shown in FIG. 2 through FIG. 4, a support frame 35 is installed to a right part of the lower frame 20, and a first support arm 36 which extends forwards is installed in a midway part of the support frame 35 in the height direction. A second support arm 37 which extends leftwards is installed to a head end part of the first support arm 36, and a guide rail 38 which extends in the horizontal direction is installed below the second support arm 37. To the fixing member 33 of the air cylinder 30 on the right side, a support plate 39 which extends below the second support arm 37 is fixed, and the a head end part of the support plate 39 is supported movably in the horizontal direction with respect to the guide rail 38 of the second support arm 37, and the support plate 39 is configured to move in the horizontal direction together with the holding roller 34 by the air cylinder 30 on the right. A drive means 67 primarily composed with an electrically operated motor 41 is installed to the support plate 39 and by rotating and driving the holding roller 34 on the right side by the drive means 67, the outer rim 2A held on the three holding rollers 34 is configured to be rotatable at a low speed.

Now, the description will be made on the grinding means 14. As shown in FIG. 2 through FIG. 5, on an upper left side of the support frame 35, a pair of top and bottom guide rails 42 which extend in the longitudinal direction are fixed. A movable frame 43 is supported movably in the longitudinal direction by the guide rails 42. This movable frame 43 is supported in such a manner as to enable adjustment of a position thereof in the longitudinal direction by a moving means 46 which includes a screw shaft 44 rotatably supported by the support frame 35, a nut member 45 fastened to a halfway part of the screw shaft 44, and an electrically operated motor 66 that rotates and drives the screw shaft 44.

A pair of anteposterior guide rails 47 which extend in the vertical direction are installed on a left side of the movable frame 43, in which the guide rail 47 is provided with an elevating plate 48 vertically and movably installed. An air cylinder 49 is installed on a center part of the movable frame 43 in the vertical direction, and the elevating plate 48 is vertically movably supported by the air cylinder 49.

On a left side of the elevating plate 48, an angle setting plate 50 is installed in such a manner to rotate around a shaft member 51. A pair of top and bottom slender circular-arc holes 52 centering around the shaft member 51 are formed on the elevating plate 48. This angle setting plate 50 is aimed to set the angle of abrasive cloth/paper 13 with respect to the outer rim 2A set to the support means 11 is optimized when the plating removing apparatus 10 is assembled. Because the angle setting plate is fixed to the elevating plate 48 with care to prevent tilting after the plating removing apparatus 10 is assembled, it may be allowed to be omitted.

An electrically operated motor 53 is installed to an upper left of the angle setting plate 50, and a pivotably supported shaft 54 is rotatably mounted to a bottom side of the electrically operated motor 53, and an oscillating plate 55 which extends leftwards is installed to a halfway part of the pivotably supported shaft 54. An arm member 56 that extends leftward is installed on an upper end part of the angle setting plate 50, and a pressurizing cylinder 57 and a helical extension spring 58 are installed in parallel between a left end part of the arm member 56 and a left end part of the oscillating plate 55. A spindle 59 that supports the abrasive cloth/paper 13 is rotatably supported to a left-end bottom of the oscillating plate 55, and the abrasive cloth/paper 13 having a nearly disk-form flap wheel is mounted to a head end part of the spindle 59. However, other wheels can be used as the abrasive cloth/paper 13 other than flap wheel. In particular, it is preferable to use the abrasive cloth/paper whose outer circumferential surface can be deformed along the curved surface of the welding planned portion R because plating can be neatly ground and removed from the welding planned portion R by one treatment.

It is configured in such a manner that a first pulley 61 is fixed to a rear end part of a rotary shaft 60 of the electrically-operated motor 53, a second pulley 62 and a third pulley 63 are fixed to a rear end part of the pivotably mounted shaft 54, and a fourth pulley 64 is fixed to a rear end part of the spindle 59, in which a belt 65 is stretched between the first pulley 61 and the second pulley 62 and between the third pulley 63 and the fourth pulley 64, respectively, so that a rotating force of the electrically operated motor 53 is transmitted to the spindle 59 via the two belts 65 and the abrasive cloth/paper 13 is rotated.

The rotating speed of the outer rim 2A can be optionally set, but in order to sufficiently secure the processing capacity and surface properties of the base material, the rotating speed of the outer rim 2A is set to be, for example, 5-100 rpm, the rotating speed of the abrasive cloth/paper 13 is set to be 1500-3000 rpm, the pressurizing contact force of the abrasive cloth/paper 13 with respect to the outer rim 2A is set to be 0.5 kN-1.5 kN so as to provide a configuration that the welding planned portion R can be subjected to a grinding treatment during a single rotation of the outer rim 2A. However, it is also possible to provide a configuration in which the grinding treatment is completed during multiple rotations of the outer rim 2A or the grinding treatment is divided into multiple grinding treatments to be carried out in the axial direction. The width of the abrasive cloth/paper 13 is preferably set to be slightly larger than that of the welding planned portion R so that plating of the welding planned portion R can be ground and removed by a single grinding treatment.

Now, an operation of the plating removing apparatus 10 is described.

Figure 6:
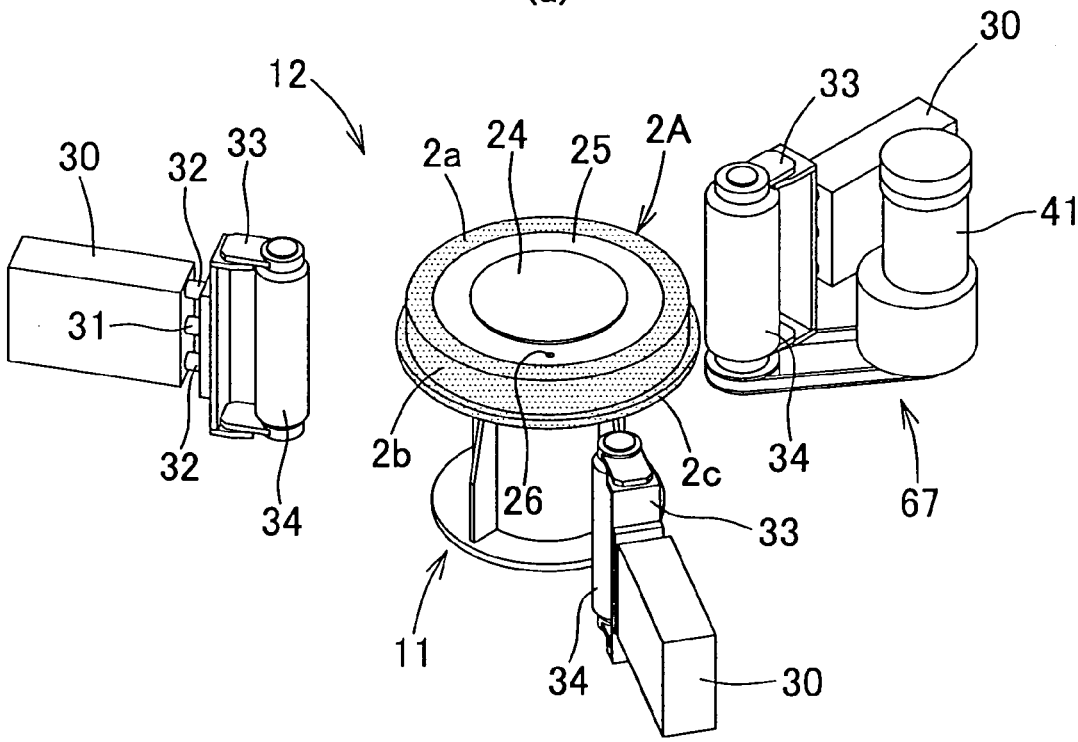
FIG. 6(*a*) is a view explaining a state of a rim being set to a supporting means and FIG. 6(*b*) is a view explaining a state of the rim being held by holding rollers.
Figure 6:
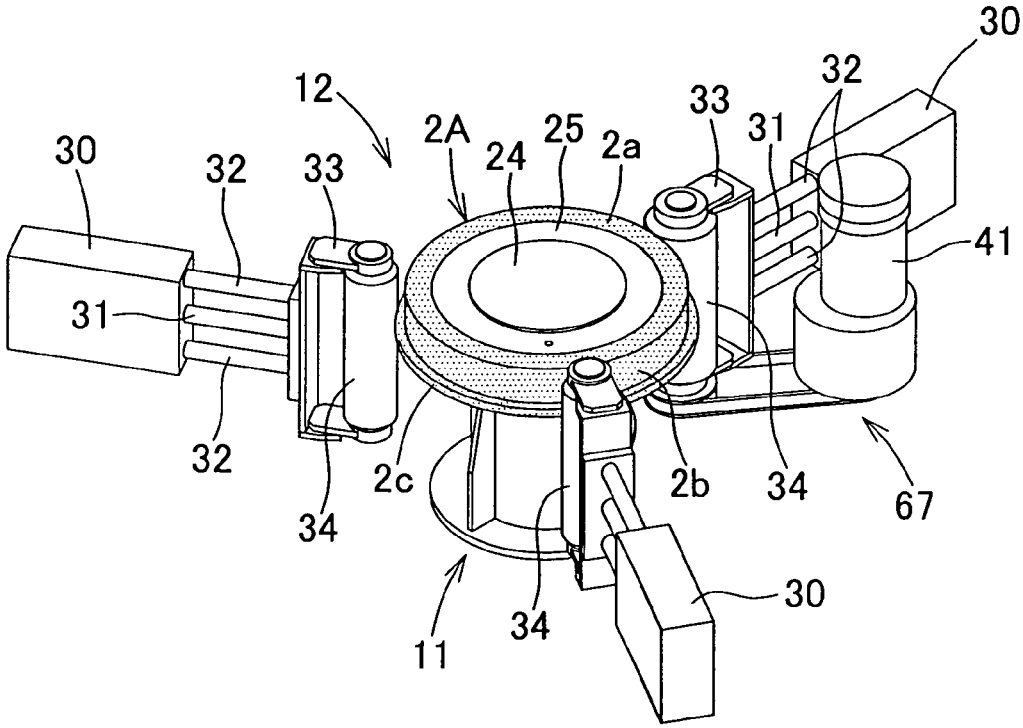

First of all, as shown in FIG. 4 and FIG. 6(*a*), the jig plate 25 suitable for the size of the outer rim 2A which is subjected to a treatment is set to the rotary plate 24, in which the outer rim 2A is set to the jig plate 25 in substantially vertical direction to the shaft center, and a side of the superimposed part 2*a* is made to be upward and the body part 2*b* is made to extend downwards from the superimposed part 2*a*.

Then, as shown in FIG. 6(*b*), the holding roller 34 is allowed to advance by the air cylinder 30 and the outer circumferential part of the flange part 2*c* set to the support means 11 is held by the three holding rollers 34.

In this way, in a state that the outer rim 2A is held by three holding rollers 34 of the rotation drive means 12, one of the holding rollers 34 on a right side is driven to rotate so as to drive the outer rim 2A at a low speed of, for example, 20 rpm.

Figure 7:
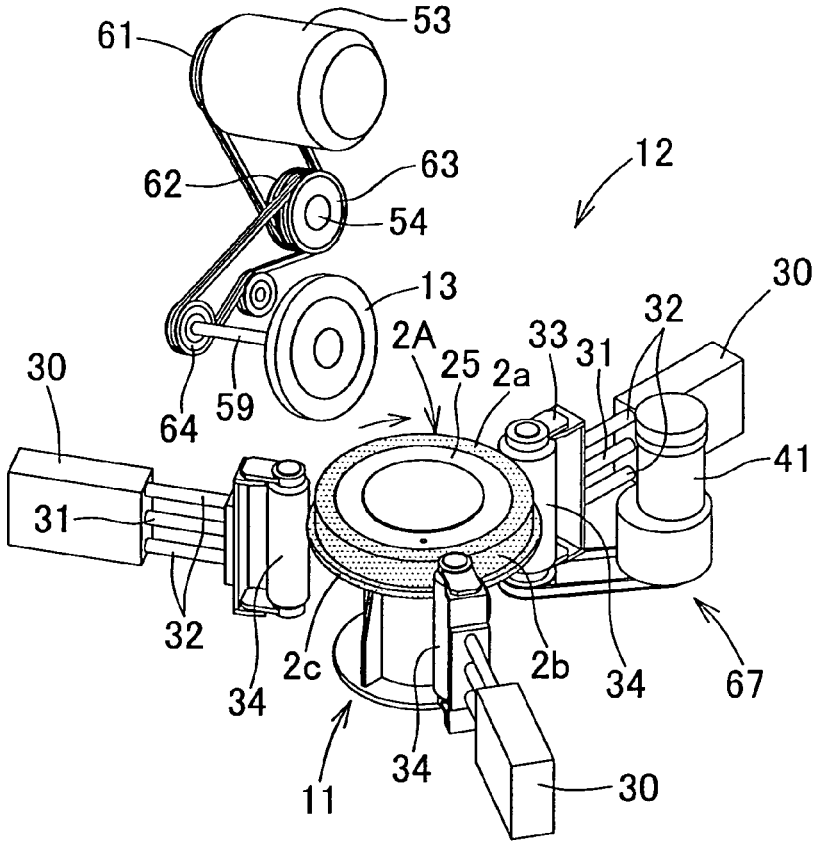
FIG. 7(*a*) is a view explaining a state immediately before grinding a welding planned portion of the rim by a grinding means and FIG. 7(*b*) is a view explaining a state of grinding the welding planned portion of the rim by a grinding means.
Figure 7:
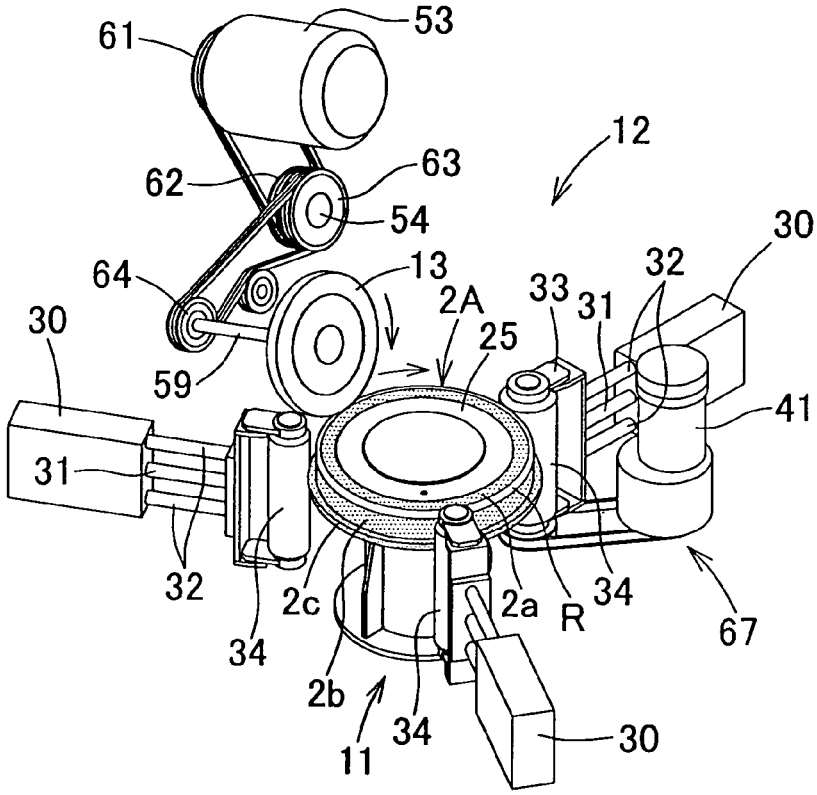

Meanwhile, as shown in FIG. 4 and FIG. 7(*a*), a vertical position and a longitudinal position of the abrasive cloth/paper 13 are adjusted by the air cylinder 49 and the electrically-operated motor 66 in such a manner that the abrasive cloth/paper 13 faces the welding planned portion R of the outer rim 2A with a subtle clearance provided in accordance with the size of the outer rim 2A. An adjustment of the vertical position and the longitudinal position of the abrasive cloth/paper 13 may be provided by a configuration to obtain an optimum positions by entering numerical values set in advance for each of the outside diameter sizes of the outer rim 2A into the plating removing apparatus 10 or it may also be a configuration to install a measuring means that measures a protrusion rate of the output rod 31 of the air cylinder 30, in which the protrusion rate of the holding roller 34 is measured by the measuring means in a state of holding the flange part 3*c* of the outer rim 2A, and the outside diameter size of the outer rim 2A is calculated on the basis of this measurement result, thereby the positions are automatically adjusted in accordance with the outside diameter sizes of the rim 2A having the vertical position and the longitudinal position of the abrasive cloth/paper 13 set in advance.

Figure 8:
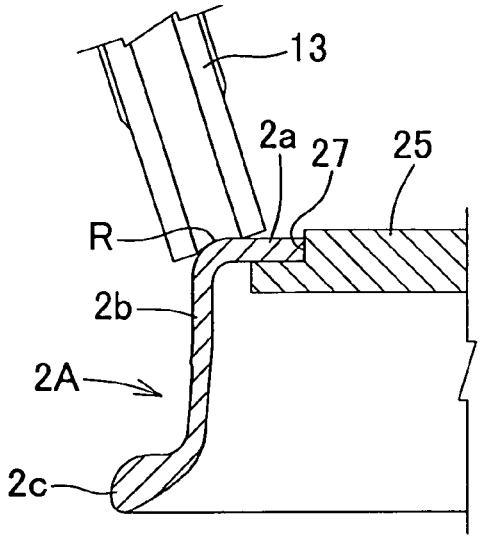
FIG. 8 is a view explaining a grinding operation by an abrasive cloth/paper.
Figure 9:
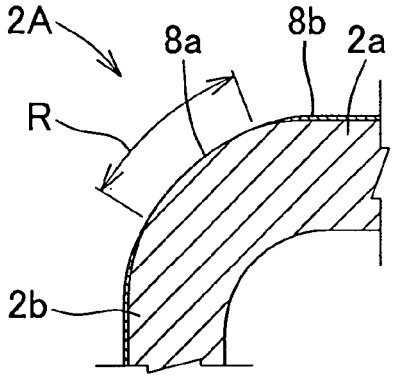
FIG. 9 is a view explaining a ground area.
Figure 10:
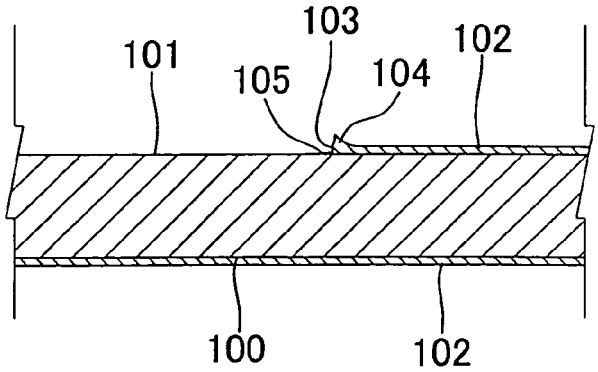
FIG. 10 is a view explaining the ground area by masking or cutting related to a conventional technique.

And as shown in FIG. 7(*b*), while the abrasive cloth/paper 13 is rotated by the electrically operated motor 53, the abrasive cloth/paper 13 is pressed against and brought in contact with the welding planned portion R of the outer rim 2A by the pressurizing cylinder 57, so that plating of the welding planned portion R is ground and removed. In such event, the abrasive cloth/paper 13 is pressed against and brought in contact with the center part of the welding planned portion in the substantially vertical direction, and an outer circumferential surface of the abrasive cloth/paper 13 is deformed in such a manner that the center part in the thickness direction is slightly dented along the curved surface of the welding planned portion R as shown in FIG. 8, thereby the welding planned portion R with a wide width is subjected to the grinding treatment collectively. In addition, as shown in FIG. 9, in the welding planned portion R and its vicinity that have been subjected to the grinding treatment, the base material area 8*a* and the plated area 8*b* of the welding planned portion R are smoothly linked and no level difference is formed at the boundary between the base material area 8*a* and the plated area 8*b*, thereby exfoliation of the plated area 8*b* can be effectively prevented.

In this way, while the outer rim 2A is allowed to make a single rotation by the rotation drive means 12, the welding planned portion R is successively subjected to the grounding process, and when grinding of the welding planned portion R is completed, pressurization by the pressurizing cylinder 57 is stopped to separate the abrasive cloth/paper 13 from the outer rim 2A, while suspending the rotation of the abrasive cloth/paper 13, reversing the holding roller 34 to remove the outer rim 2A subjected to the grinding treatment from the jig plate 25, and setting a new outer rim 2A to the jig plate 25, so as to grind and remove plating of the welding planned portion R again in the same manner as stated above. In the present embodiment, the welding planned portion R is successively subjected to a grinding treatment during a single rotation of the outer rim 2A. The grinding treatment can be carried out during multiple rotations of the outer rim 2A or the welding planned portion R may be divided into multiple portions in the width direction to carry out the grinding treatment successively.

What is claimed is:

1. A plating removing apparatus for a three-piece wheel for removing plating of a welding planned portion of an outer rim or an inner rim in a three-piece wheel having an inner rim, outer rim, and disk, comprising:

a support means including a jig plate that rotatably supports the outer rim or the inner rim, wherein said jig plate is exchangeable in correspondence with the inner diameter of the outer rim or the inner rim, and wherein the outer rim or the inner rim is positioned against the jig plate;

at least 3 holding rollers that hold the outer rim or the inner rim supported by the support means from an outer circumferential side of the outer rim or inner rim;

a rotation drive means that rotates and drives the outer rim or the inner rim held by the holding rollers; and a grinding means that grinds the welding planned portion on the outer circumferential surface of the curved part of the outer rim or the inner rim with an abrasive cloth or paper, and removes plating of the welding planned portion.

2. The plating removing apparatus for a three-piece wheel according to claim 1, wherein a flap wheel is used as the abrasive cloth or paper by arranging the abrasive cloth or paper radially and the flap wheel is pressed and brought in contact with a center part of the welding planned portion as the grinding means in the substantially vertical direction to grind the welding planned portion.

3. The plating removing apparatus for a three-piece wheel according to claim 1, wherein a level difference part is formed to an outer circumferential part of the jig plate of the supporting means, an inner circumferential part of the outer rim or the inner rim is fixed over the level difference part, and the outer rim or the inner rim is positioned against the jig plate.

4. A plating removing apparatus for a three-piece wheel for removing plating of a welding planned portion of an outer rim or an inner rim in a three-piece wheel having an inner rim, outer rim, and disk, comprising;

a support means that rotatably supports the outer rim or the inner rim;

at least 3 hold rollers that hold the outer rim or the inner rim supported by the support by the support means from an outer circumferential side of the outer rim or the inner rim;

a rotation drive means that rotates and drives the outer rim or the inner rim held by the holding rollers; and a grinding means that grinds the welding planned portion on the outer circumferential surface of the curved part of the outer rim or the inner rim with an abrasive cloth or paper and removes plating of the welding planned portion, further comprising a measuring means that measures a protrusion rate of one of the holding rollers while the outer rim or the inner rim is held and a moving means that moves the grinding means in such a manner as to bring the abrasive cloth or paper properly in contact with the welding planned portion on the basis of a calculation result obtained by calculating a diameter of the wheel on the basis of an output from the measuring means.

5. A plating removing apparatus for a three-piece wheel for removing plating of a welding planned portion of an outer rim or an inner rim in a three-piece wheel having an inner rim, outer rim, and disk, comprising;

a support means that rotatably supports the outer rim or the inner rim;

at least 3 hold rollers that hold the outer rim or the inner rim supported by the support by the support means from an outer circumferential side of the outer rim or the inner rim;

a rotation drive means that rotates and drives the outer rim or the inner rim held by the holding rollers; and a grinding means that grinds the welding planned portion on the outer circumferential surface of the curved part of the outer rim or the inner rim with an abrasive cloth or paper and removes plating of the welding planned portion, further comprising a measuring means that measures a protrusion rate of one of the holding rollers while the outer rim or the inner rim is held and a moving means that moves the grinding means in such a manner as to bring the abrasive cloth or paper properly in contact with the welding planned portion on the basis of a calculation result obtained by calculating a diameter of the wheel on the basis of an output from the measuring means, wherein a flap wheel is used as the abrasive cloth or paper by arranging the abrasive cloth or paper radially and the flap wheel is pressed and brought in contact with a center part of the welding planned portion as the grinding means in the substantially vertical direction to grind the welding planned portion.

6. A plating apparatus for a three-piece wheel for removing plating of a welding planned portion of an outer rim or an inner rim in a three-piece wheel having an inner rim, outer rim, and disk, comprising:

a support means that rotatably supports an inner circumferential part of the outer rim or the inner rim;

at least 3 tubular holding rollers that hold the outer rim or the inner rim supported by the support by the support means from an outer circumferential side of the outer rim or the inner rim; said holding rollers being arranged in a vertical direction on an outer side of the outer rim or the inner rim, and a middle part in a height direction being pressed and brought in contact with an outer circumferential part of the outer rim or the inner rim;

a rotation drive means that rotates and drives the outer rim or the inner rim held by the holding rollers; and a grinding means that grinds the welding planned portion on the outer circumferential surface of the curved part of the outer rim or the inner rim with an abrasive cloth or paper and removes plating of the welding planned portion.

7. The plating removing apparatus for a three-piece wheel according to claim 6, wherein the support means includes a jig plate that rotatably supports the outer rim or the inner rim, wherein said jig plate is exchangeable in correspondence with the inner diameter of the outer rim or the inner rim, and wherein the outer rim or the inner rim is positioned against the jig plate.

8. The plating removing apparatus for a three-piece wheel according to claim 7, wherein a level difference part is formed to an outer circumferential part of the jig plate of the supporting means, and inner circumferential part of the outer rim or the inner rim is fixed over the level difference part, and the outer rim or the inner rim is positioned against the jig plate.

9. The plating removing apparatus for a three-piece wheel according to claim 6, wherein a flap wheel is used as the abrasive cloth or paper by arranging the abrasive cloth or paper radially and the flap wheel is pressed and brought in contact with a center part of the welding planned portion as the grinding means in the substantially vertical direction to grind the welding planned portion.

* * * * *